US005938228A

United States Patent [19]

Bourdeau

[11] Patent Number: 5,938,228

[45] **Date of Patent: *Aug. 17, 1999**

[54] RETENTION APPARATUS FOR A BOOT ON A GLIDING BOARD

[75] Inventor: Joël Bourdeau, Saint-Jorioz, France

[73] Assignee: Salomon S.A., Metz-Tessy, France

[ * ] Notice: This patent is subject to a terminal disclaimer.

[21] Appl. No.: 08/757,285

[22] Filed: Nov. 27, 1996

Related U.S. Application Data

[63] Continuation of application No. 08/224,142, Apr. 4, 1994, Pat. No. 5,595,396.

[30] Foreign Application Priority Data

May 14, 1993 [FR] France ..... 93 06006

[51] Int. Cl.[6] ..... A63C 9/18

[52] U.S. Cl. ..... 280/607; 280/613; 280/615

[58] Field of Search ..... 280/607, 613, 280/614, 615, 632, 623, 624, 634, 627; 36/115, 117.1, 89, 88, 188.2

[56] References Cited

U.S. PATENT DOCUMENTS

| | | | |
|---|---|---|---|
| 2,693,967 | 11/1954 | Jones, Jr. | 280/613 |
| 3,061,325 | 10/1962 | Glass | 280/613 |
| 3,902,729 | 9/1975 | Druss | 280/613 |
| 3,957,280 | 5/1976 | Turnheim et al. | 280/613 |
| 4,021,056 | 5/1977 | Oakes | 280/613 |
| 4,191,395 | 3/1980 | Salomon | 280/613 |
| 4,768,804 | 9/1988 | With | 280/614 |
| 4,836,572 | 6/1989 | Pozzobon | 280/613 |
| 4,842,293 | 6/1989 | Rochard | 280/607 X |
| 4,923,207 | 5/1990 | Pozzobon | 280/613 |
| 4,973,073 | 11/1990 | Raines et al. | 280/14.2 |
| 5,035,443 | 7/1991 | Kincheloe | 280/14.2 |
| 5,064,214 | 11/1991 | Diard et al. | 280/607 |
| 5,190,310 | 3/1993 | Hauglin et al. | 280/615 |
| 5,224,730 | 7/1993 | Provence et al. | 280/615 |
| 5,505,477 | 4/1996 | Turner et al. | 280/613 |
| 5,520,406 | 5/1996 | Anderson et al. | 280/624 |

FOREIGN PATENT DOCUMENTS

| | | |
|---|---|---|
| 0396133 | 11/1990 | European Pat. Off. . |
| 0551899 | 7/1993 | European Pat. Off. . |
| 2592807 | 7/1987 | France . |
| 2631844 | 12/1989 | France . |
| 2641703 | 7/1990 | France . |
| 2669237 | 5/1992 | France . |
| 9200453 | 4/1992 | Germany . |
| WO91/11232 | 8/1991 | WIPO . |

*Primary Examiner*—Lanna Mai
*Assistant Examiner*—Avraham H. Lerner
*Attorney, Agent, or Firm*—Greenblum & Bernstein P.L.C.

[57] ABSTRACT

A retention device of a boot on a gliding board, especially a snowboard. The device includes a retention element associated with the board, cooperating with a complementary retention element associated with the boot, together ensuring a connection between the boot and the board according to different degrees of freedom. The device includes a groove for one of the elements, and a rib for the other element. The rib and the groove having complementary shapes to enable cooperation by nesting. The device also includes a gripping mechanism for one of the elements, and a latching mechanism for the other element forming a removable latch for actively retaining the rib nested in the groove.

36 Claims, 7 Drawing Sheets

11
25
15
23
28
25
19
22
20
10
21
30
31
12
17
13
18
35

11
54
51
64
66
56
55
67
57
52
62
61
70
68
60
10
71
69
73

60
61
54
55
70
71
66
62
67

RETENTION APPARATUS FOR A BOOT ON A GLIDING BOARD

CROSS-REFERENCE TO RELATED APPLICATION

This application is a continuation of application Ser. No. 08/224,142, filed on Apr. 4, 1994 now U.S. Pat. No. 5,595, 396, issued on Jan. 21, 1997.

BACKGROUND OF THE INVENTION

1. Field of the Invention

The invention concerns a retention device for a boot on a gliding board, especially on a snowboard.

The invention also concerns a boot for gliding, especially snowboarding, and a gliding board, especially for snowboarding.

2. Discussion of Background and Material Information

Snowboarding is a gliding sport which is practiced by means of a board in the form of a plate, of which the front end is raised to form the spatula or shovel. Certain boards also have the rear end raised. The skier is connected to the board by means of two retention elements which hold each of his archer boots. The retention elements are generally offset along the median longitudinal axis of the plate, and they form,- with this axis, an angle of 5 to 90° from one or the other side of this axis. This angle as well as the distance between the two retention elements can be adjustable.

There are two large families of boot retention elements on the board, depending on whether the boots are of the rigid or the flexible type. For boots of the rigid type, the retention elements generally comprise a plate on which the sole of the boot is in support. At each end of the plate, the boot is held by a stirrup which takes support on the front or rear tip of the boot.

Such a device is known, for example, from French Patent Publication No. 2,669,237.

Another device of this type is known from European Patent Publication No. 0,396,133. This device additionally comprises an intermediary plate which is connected to the gliding board by a linkage of the releasable type. However, the boot is held on the plate by means of conventional stirrups.

A retention device from French Patent Publication No. 2,592,807 is also known, for example, for flexible type boots, i.e., shoes which resemble boots. These binding elements generally comprise a rigid shell which is assembled at the surface of the gliding board and inside of which the boot is inserted and retained.

The currently known retention elements have the disadvantage of being cumbersome, either in terms of length of the boot or in terms of height. In addition, besides the orientation adjustment of the boots with respect to the longitudinal direction of the plate, they require adaptation adjustments to the boot of the surfer/snowboarder, mainly to its length. Further, currently known retention elements occupy a substantial surface of the board, and therefore disturb its flexion and/or torsion during the glide.

SUMMARY OF THE INVENTION

One of the objects of the invention is to propose a retention device of a boot on a gliding board which is less cumbersome.

Another object of the invention is to propose a retention device for the board which ensures good transmission of the forces that the skier produces during the slide.

Another object of the invention is to propose a retention device whose construction is particularly simple.

Another object of the invention is to propose a retention device which can be adapted to boots of different length and volume without special adjustment.

Other objects and advantages of the invention will become apparent upon reading the following description, this description being given as a non-limiting guide.

The retention device of a boot on a gliding board according to the invention comprises a retention element associated with the board cooperating with a complementary retention element associated with the boot, the assembly ensuring a linkage between the boot and the board according to the different degrees of movement of the boot with respect to the board.

The invention includes a means defining a groove for one of the elements and a means defining a rib for the other element, the rib and the groove having complementary shapes in order to cooperate by nesting; the invention also includes a hooking means for one of the elements and, for the other, a retention means forming a removable latch to actively retain the rib nested into the groove at least along the nesting direction, and wherein it further comprises a control means to at least open the latch voluntarily.

BRIEF DESCRIPTION OF THE DRAWINGS

The invention will be better understood by referring to the description below, as well as to the annexed drawings which are an integral part thereof.

DETAILED DESCRIPTION OF THE PREFERRED EMBODIMENTS

Figure 1:
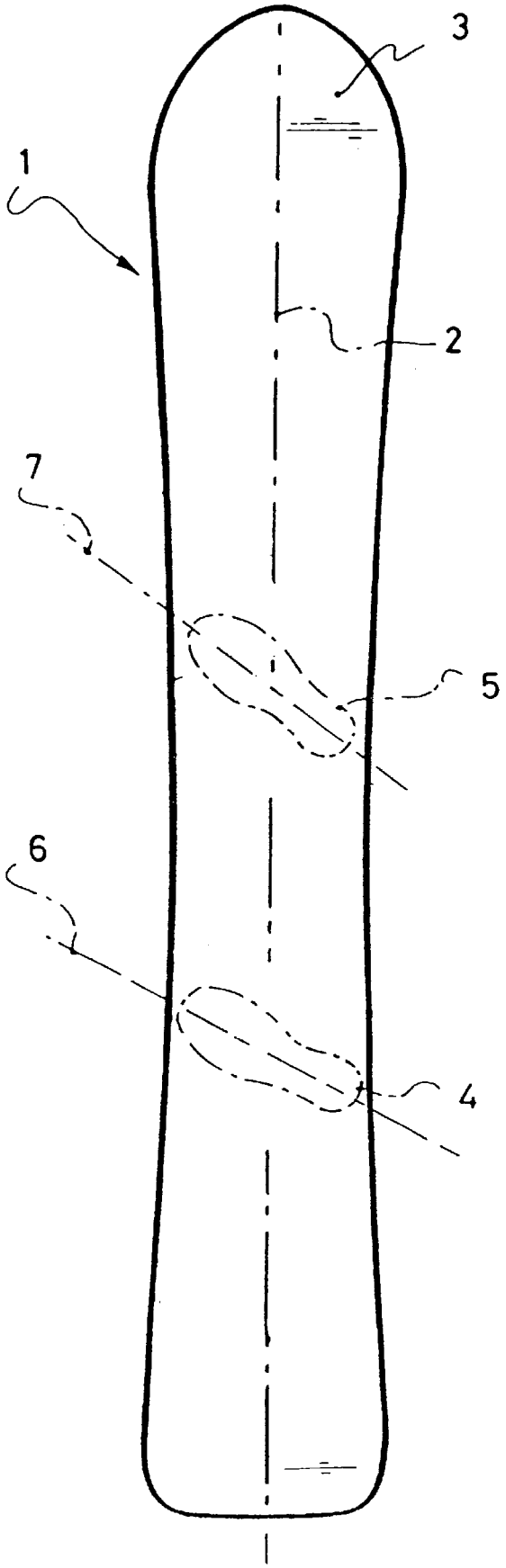
FIG. 1 schematically represents a bottom view of a gliding board such as a snowboard.

In FIG. 1, a snowboard 1 is schematically represented in a top view. The board is in the form of a plate elongated along a median longitudinal direction 2. The lateral edges of the board are most often incurved according to what is commonly known as dimension lines.

Generally, the front end 3 of the board is raised to form the spatula or shovel. The rear end can also be raised, according to the nature of the gliding discipline which is practiced.

The surfer/snowboarder is connected to the board 1 by means of both his or her boots which are held at the upper surface of the board by retention devices. Usually, the boots of the surfer/snowboarder are retained next to one another along the median longitudinal direction 2, in the central zone of the board, at a distance of approximately 45 cm apart. Their position is schematically represented and identified by reference numerals 4 and 5. Both boots are oriented respectively along directions 6 and 7 which are oriented obliquely with respect to direction 2. The angles of orientation vary as the case may be between 90 and 5 degrees from either side of the longitudinal direction depending upon whether the surfer/snowboarder is of a "goofy" or "regular" nature. In general, these angles are adjustable. The spacing of the boots can also be adjustable. The width of the board in the central zone is close to or less than the length of the boot.

Naturally, this is only given as a guide and not as a limiting value for the invention. Indeed, there are a number of embodiments of such a gliding board, in particular numerous different forms, symmetrical or asymmetrical, adapted especially to the build of the snowboarder/surfer and to the gliding discipline practiced.

According to the invention, each boot is retained on the board by a retention device. The retention device comprises an element associated with the boot and an element associated with the board. One of the elements has a means forming a rib, the other device has a means forming a groove. The rib and the groove sectionally have complementary shapes for nesting in one another. Preferably, these shapes ensure an automatic taking up of play. The device additionally comprises a latching means for retaining the rib nested in the groove.

Figure 2:
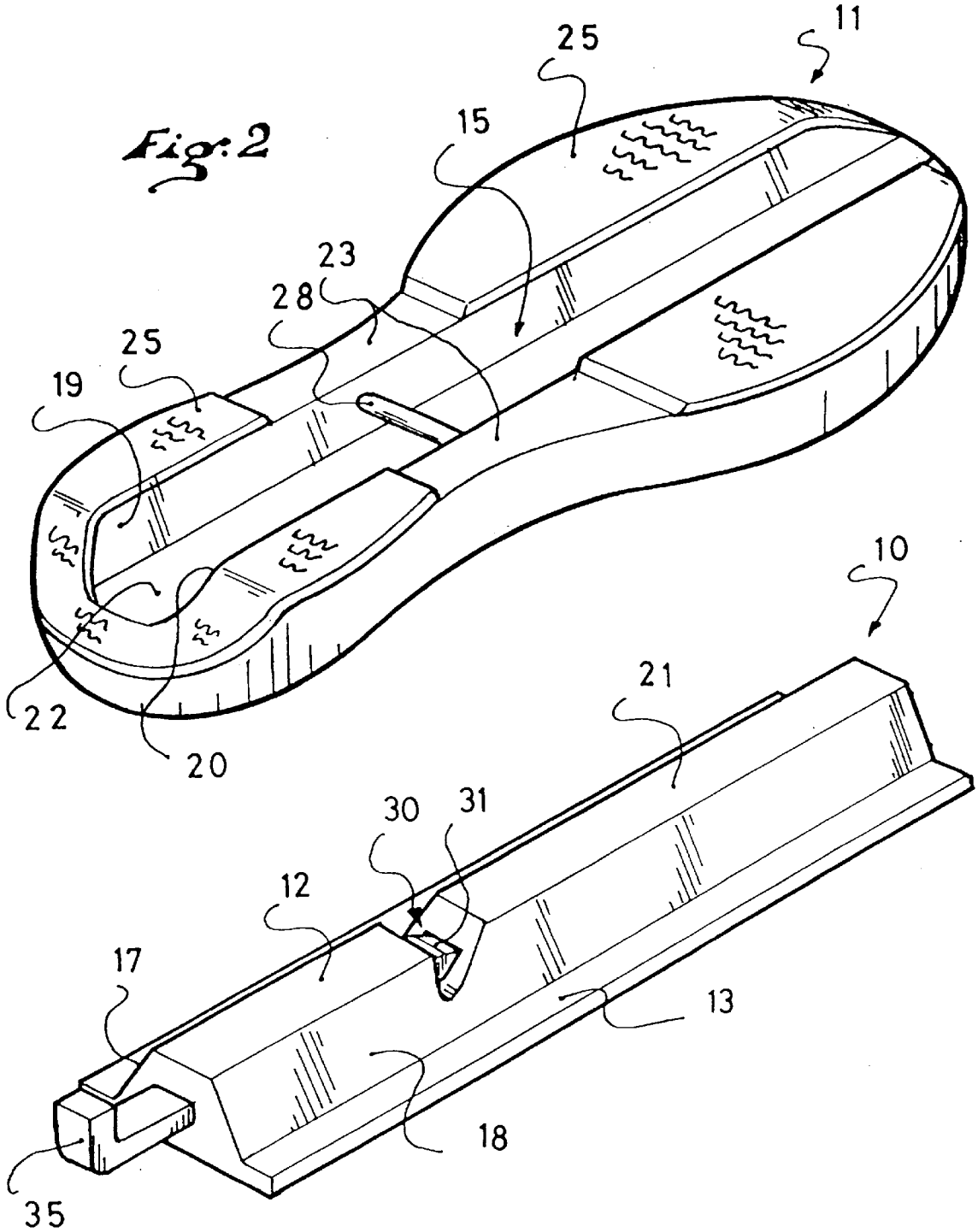
FIG. 2 is a schematic perspective view which illustrates the retention element associated with the board and the retention element associated with the boot according to a first non-limiting implementation of the invention.

FIG. 2 schematically illustrates a first implementation of the invention. This figure represents in perspective a retention element 10 associated with the board and a retention element 11 associated with the sole of the boot.

The retention element 10 has the shape of a rib 12 oriented along the longitudinal direction defined by the sole of the boot, having, in its lower portion, a base 13 intended for affixing to the element of the board. In a complementary fashion, the retention element 11 has a longitudinal groove 15, which, in the example illustrated, opens frontwardly and rearwardly. This is intended to facilitate the evacuation of snow and is non-limiting. The rib 12 and groove 15 have similar lengths. This length is approximately the same as the length of the boot.

Figure 3:
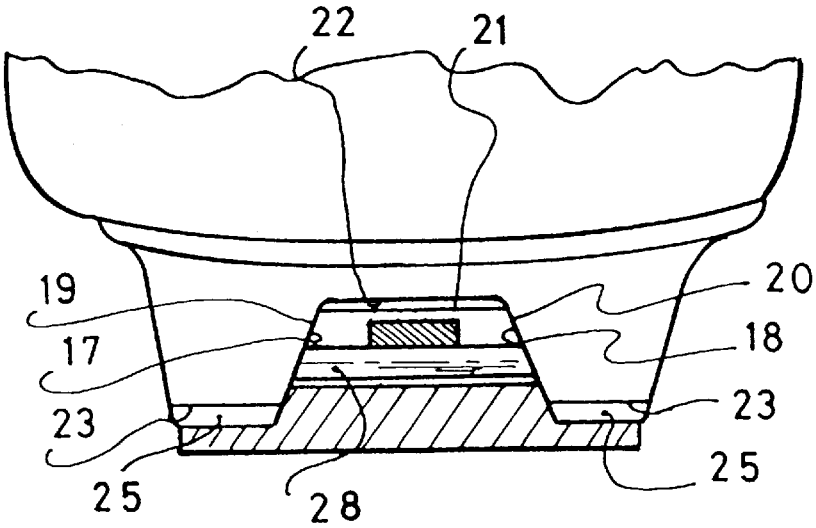
FIG. 3 is a transverse sectional view of the two elements of FIG. 2 nested on one another.
Figure 4:
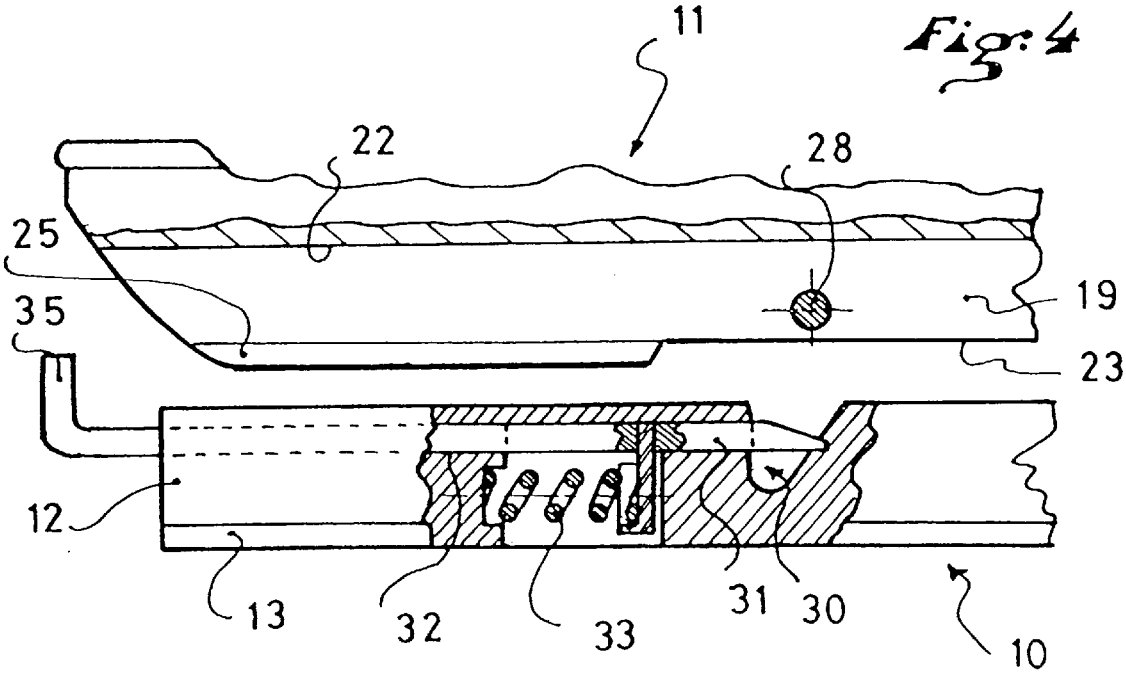
FIG. 4 is a partial longitudinal sectional view of the two superposed elements of FIG. 2 before their nesting.

FIG. 3 represents a transverse section of the element 11 nested on the element 10. As is visible, the lateral sides 17, 18 of the rib 12 are, preferably, inclined with respect to a vertical plane, such that the rib is enlarged downwardly. The lateral sides 19 and 20 of the rib are also inclined in a complementary fashion such that the lateral sides of the rib and the groove form complementary engagement surfaces when the rib and the groove form complementary engagement surfaces generally face transversely with respect to the longitudinal direction.

Preferably, the widths of the rib and groove are determined so that the adjustment and support between the rib and the groove along a vertical direction take place by relative support of their respective lateral sides.

However, this is non-limiting, and the vertical support between the two elements could also be obtained by cooperation of the top 21 of the rib with the base 22 of the groove, or even by the edges 23 of the groove with the lateral edges of the base 13, or any other appropriate means. For example, the lateral edges 23 of the groove could be equipped, at least locally, with strips or slip soles 25 of elastically deformable material which simultaneously ensure partial support of the vertical forces, a taking up of the play, and if necessary, a slight elastic play during the glide. These strips or slip soles can also be useful for walking.

The device illustrated in the figures further comprises a latching mechanism for retaining the nesting of the rib and the groove. To this end, the figures represent for element 11, a transverse profile 28 forming a catch for retention of the element 11, the catch being located towards the center of the rib, and which extends between its two lateral edges towards mid-height. The profile 28 is circular, for example, taking the form of a pin or rod, but it can also be sectionally presented in any other form.

In order to receive the profile 28, the rib 12 has on its side, a notch 30 which is oriented along a transverse direction. Preferably, as is visible, the notch 30 is flared upwardly in order to facilitate guiding of the profile 28 when it is introduced.

The rib 12 further has a kind of sash bolt or jaw 31 or latch, which is movable along a longitudinal direction, and which is positioned to be capable of blocking the profile or catch 28 at the bottom of notch 30. For example, the latch is located mid-width of rib 12; it is slidably mounted in a housing or guide 32 along a longitudinal direction, and is elastically returned to the sealing position of the notch 30 by a spring 33.

A tie rod 35 or any other appropriate means is connected to the latch 31. The tie rod enables the latch to momentarily retract into the rib to release the opening of the notch 30. The tie rod could also be replaced by a lateral lever or by any other appropriate means for maneuvering the latch, especially a flexible means such as a cable.

Advantageously, the latch 31 has an inclined upper surface which enables an automatic engagement of the profile in the notch by a vertical pressure of the profile on the tie rod. If necessary, the lower surface of the latch is slightly inclined to ensure automatic taking up of play on the profile 28. In addition, the face of the notch opposite to the latch can have an opening in which the end of the latch is engaged in a position for sealing the notch.

Under the level of the tie rod, the notch has sectional dimensions that are very close to those of the profile 28 to ensure its retention without practically any play.

The device operates as follows. The element 11 associated with the boot constitutes, for example, the lower portion of the sole of a boot, which is overlaid by a shell or an appropriate upper. This shell or this upper are not represented in the various figures. The element 10 is affixed to the surface of the gliding board according to a desired orientation. The affixation is obtained by any appropriate means. Possibly, the orientation of the element 10 with respect to the median longitudinal direction 2 of the board is adjustable. Any other adjustment can also be added, especially an inclination adjustment of the boot with respect to a direction perpendicular to the board, or an adjustment of the distance separating the element 10 from the other retention element of the other boot.

When putting on the boot, the surfer positions his or her boot so that it is nested on the rib 12, and the profile 28 is presented at the opening of the notch 30. If necessary, he or she can facilitate this positioning by a front-to-rear tipping movement of the boot. By vertical pressure of the boot, the surfer forces the latch 31 to open, thereby enabling the penetration, and then the latching of the profile into the notch. The cooperation between the rib and the groove on the one hand, the profile, the notch and the latch on the other hand, ensures a linkage between the two retention elements according to all the direction of movement. In particular, the latching mechanism i.e., the profile 28, the notch 30, and the latch 31, ensure a linkage along the vertical nesting direction and along the longitudinal direction defined by the rib.

In order to release his or her boot at will, the surfer exerts a traction on the tie rod 32, thus enabling the release of the profile 28 from notch 30.

According to the invention, the rib and the groove which cooperate together, can have any appropriate form, and do not necessarily have a transverse section of constant dimensions along their length. In addition, the rib and/or the groove are not necessarily continuous along their principal direction.

Figure 5:
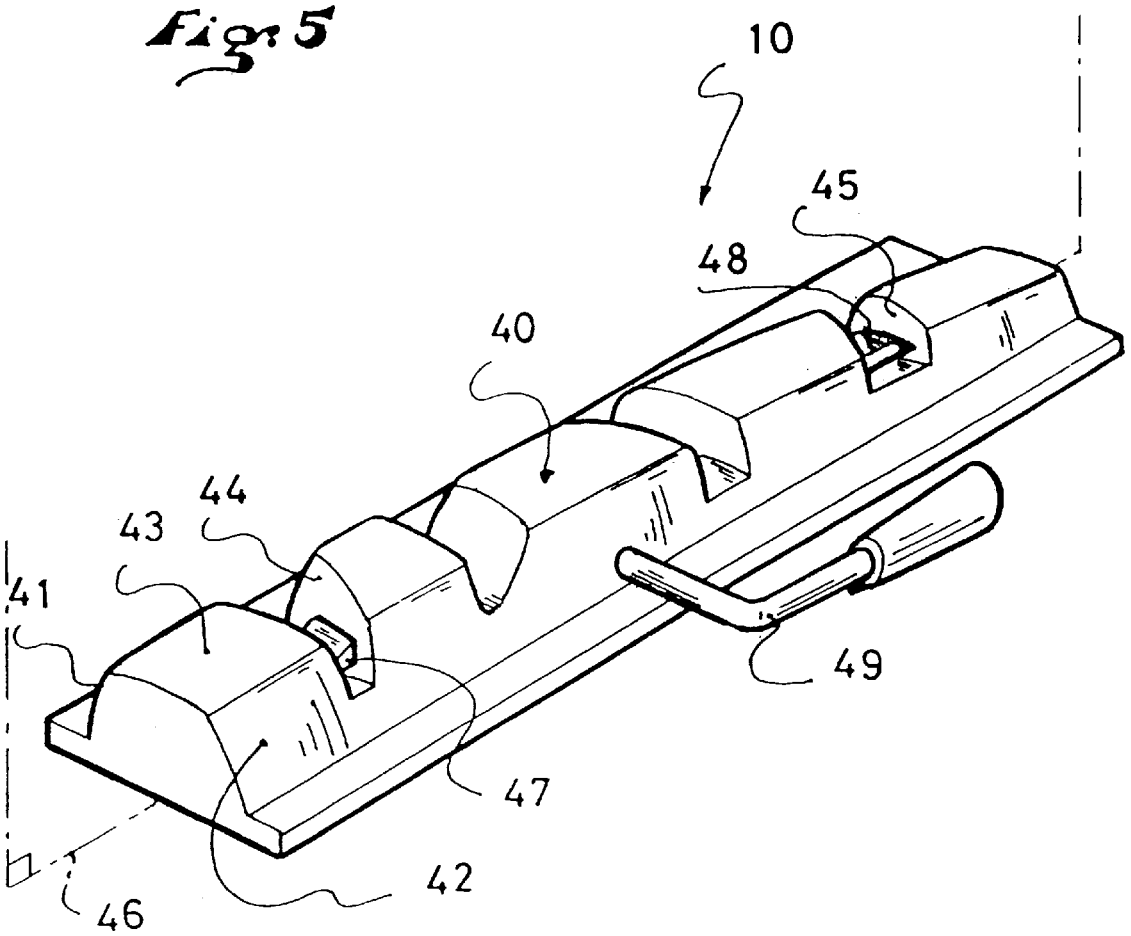
FIG. 5 represents a perspective view of a variation of the embodiment of the retention element which is associated with the board.

To illustrate this, FIG. 5 represents the retention element 10 in the form of a rib 40 of which the lateral sides 41, 42 are substantially bulged and globally have asymmetrical inclinations with respect to a median longitudinal and vertical plane as schematically shown and identified by reference numeral 46. In addition, the top 43 of the rib is inclined with respect to a horizontal plane. FIG. 5 also represents recesses 44 and 45 distributed along the length of the rib. These different variations can be implemented together or separately.

In this variation, the latching mechanism is represented with two sash bolts or jaws or latches 47 and 48, located at the level of the ribs 44, 45, of which the opening is controlled by a lateral lever 19. The linkage of the lever to the latches is within reach of one with ordinary skill in the art. The boot, in this case, has a hooking means or catch in two portions located at the front and the rear of the sole. These portions cooperate with the latches 47, 48 and have a constant distance whatever the length of the boot may be.

Other adaptations could also be adopted. For example, the rib, seen from the top, could have a triangular form or a sectional triangular form on at least a portion of its length. The rib could also have several secondary arms so as to form for example, a "T", a "Y" or any other appropriate form. One could also be led to locally equip the various faces of the groove and the rib with complementary forms serving as a polarizing slot, i.e., preventing the engagement of the boot on the element associated with the board in a wrong direction.

Naturally, the other retention element has a groove of which the sectional dimensions are appropriate to those of the rib.

Preferably, the rib and the groove ensure an immobilization of the boot on the board about a vertical direction and along a direction transverse to the principal direction of the rib. As for the latching mechanism, it ensures a linkage along an upward vertical direction and along the principal direction of the rib. Possibly, this longitudinal linkage can be obtained by the nesting of the rib and the groove, because of their form or, for example, by transverse secondary ribs which cooperate with grooves or secondary recesses.

Figure 6:
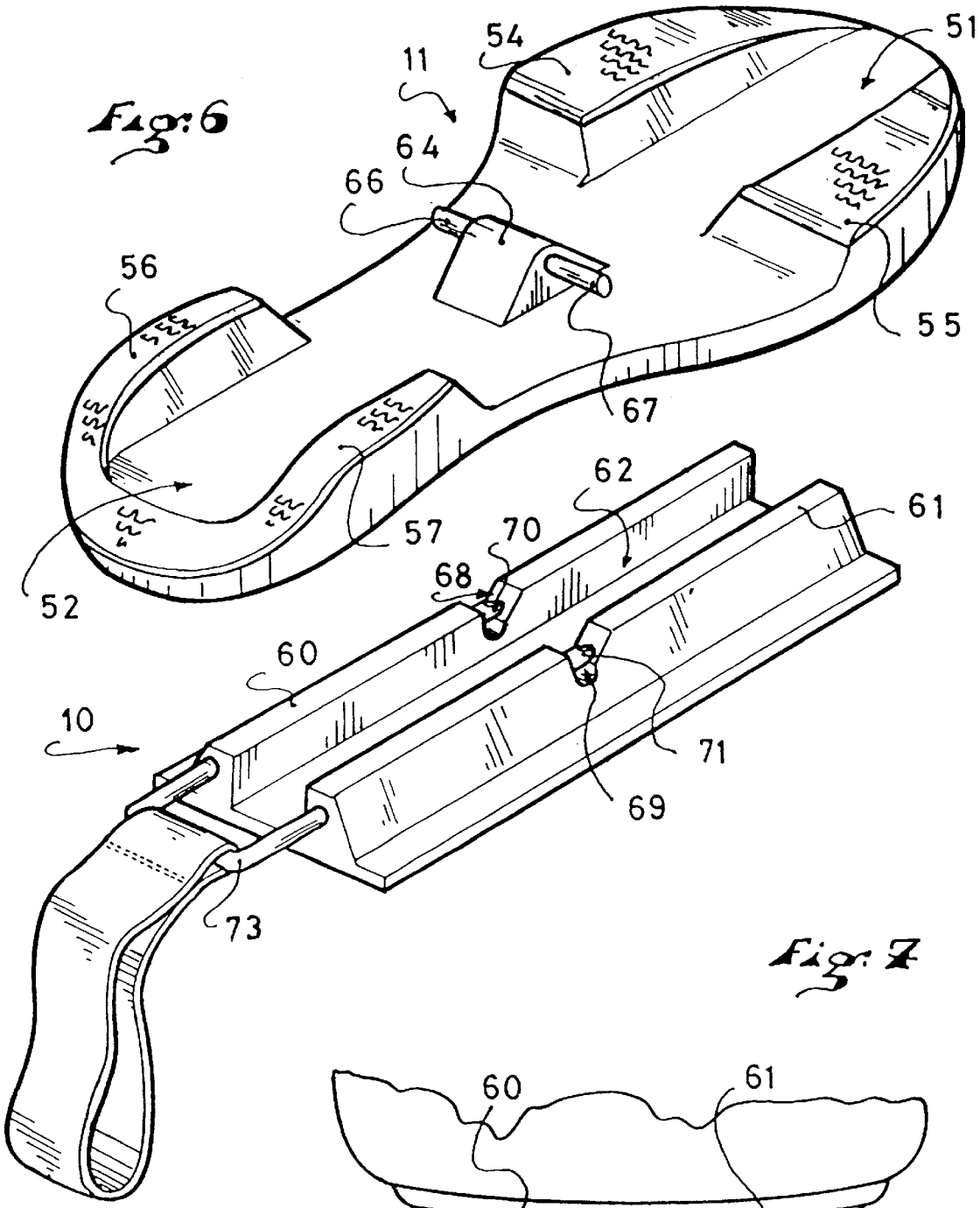
FIG. 6 is a schematic view from a splintered perspective which illustrates the retention element associated with the board and the retention element associated with the boot, according to another implementation of the invention.
Figure 7:
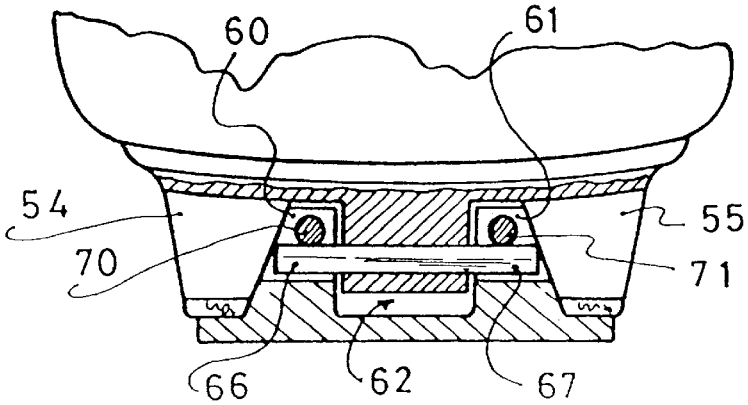
FIG. 7 is a transverse sectional view of the two elements of FIG. 6 nested on one another.

FIG. 6 represents another variation of the invention. According to this variation, the retention element 11 associated with the boot is generally presented as a groove composed of two portions 51 and 52, respectively located at the front and rear of the element in alignment with each other. The two groove portions 51 and 52 are laterally limited by lateral portions 54, 55, 56, and 57, respectively. Preferably, these edges are incurved frontwardly and rearwardly to facilitate walking. The portions 55 and 57, 54 and 56 are separated by recesses on the same side of the element.

The element 10 associated with the board is presented as a rib laterally limited by two lateral portions 60 and 61. The element 10 has a longitudinal recess 62 between the portions 60 and 61 along a transverse direction. The recess 62 opens frontwardly and rearwardly. The length of the rib is close to or less than the length of the rib formed by the lateral portions 54 to 57.

As in the preceding case, the dimensions of a transverse section of the rib formed by the longitudinal portions 60 and 61 are complementary to those of the groove formed by the portions 54 to 57 to ensure a nesting of the rib in the groove. Preferably, the sides of the rib and groove are inclined with respect to a vertical plane.

However, the form and the dimensions of a transverse section are not limiting for the invention. One can also implement variations of form and inclination of the sides such as those described hereinabove.

Furthermore, the device has a latching mechanism. According to FIG. 6, element 11 has, in its central portion between the portions 51 and 52, a form 64 which extends in relief along a longitudinal direction on the bottom of the groove. This form in relief is intended to be engaged in the recess 62 of the rib, between the longitudinal portions 60 and 61. It has dimensions in a transverse section that are less than or equal to those of recess 62 to be capable of engaging in the recess. However, an adjustment of these forms between one another is not indispensable.

Laterally, the form in relief 64 has two lateral pins 66 and 67, which forming a catch, extend transversely so that the distance between their ends is approximately equal to the width of the rib. Possibly, the pins 66 and 67 are the ends of a profile of which the central portion is embedded in the form in relief 64.

Complementarily, the longitudinal portions 60, 61 of the rib have two notches 68 and 69 which are intended to receive the lateral pins 66 and 67.

The latching mechanism further comprises two sash bolt or jaws or latches 70 and 71 which are guided into the lateral portions 60 and 61. These latches have the same function as the latches described hereinabove. They can be maneuvered by a tie rod 73. For example, the tie rod and the latches are constituted by a "U-bend" profile, of which the two lateral arms are guided inside the longitudinal portions 60 and 61. This is not limiting, and the latches could be maneuvered by a lateral lever or by any other appropriate means.

As in the preceding case, the latches can be returned to a closing position of the notches by an elastic means such as a spring, the notches 68 and 69 can be flared upwardly, and the latches can be equipped with ramps to facilitate introduction and automatic latching of the pins 66 and 67 in the notches, and if necessary, to take up the play at this level.

Figure 8:
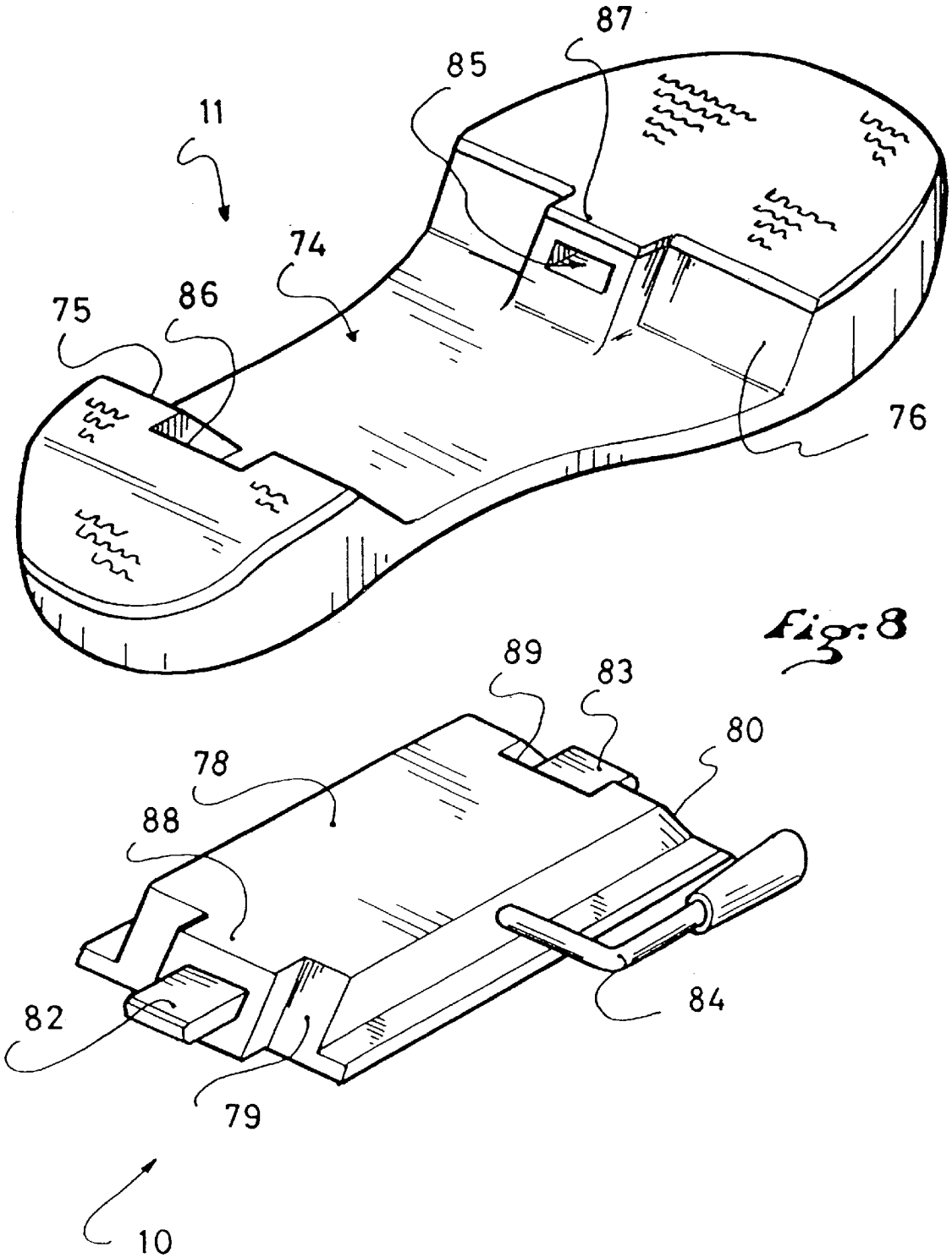
FIG. 8 represents the retention elements according to another variation of implementation of the invention.

FIG. 8 represents another variation of the invention. According to this variation, the element 11 associated with the boot is in the form of a groove 74 oriented along the width of the element 11. The groove opens laterally from each side of the sole, and it is limited at the front and the rear of the boot by two inclined sides 75 and 76. In the example illustrated, the distance between the sides 75 and 76 is greater than the width of the element 11 in its central portion.

The element 10 associated with the board has a rib 78 oriented along the width of the element. The rib 78 is limited on the front and the rear of the boot by two inclined sides 79 and 80 which are intended to cooperate with sides 75 and 76 of the groove to form complementary engagement surfaces when the rib is nested within the groove. In this embodiment, the surfaces generally face in a longitudinal direction.

The latching mechanism comprise two elements 82 and 83 for the rib, located towards the middle of sides 79 and 80 and functioning in the manner of movable slides or jaws whose retraction into the rib is controlled by the lateral lever 84.

In the area of the inclined sides 75 and 76, the rib has housings forming a kind of catching system in which the elements 82 and 83 are intended to be engaged to retain element 11 nested on element 10. Only depression 85 of side 76, functioning as a catch, is visible in FIG. 8.

Possibly, as is represented in FIG. 8, sides 75, 76, 79 and 80 of the rib and of the groove can have complementary recessed and raised forms 86–89 which are intended to improve the retention of the nesting along the various directions, or to prevent nesting of element 11 in a wrong direction.

In addition, possibly only one of the elements 82 or 83 could be movable under the control of lever 84, the other element being fixed.

In any event, preferably, the elements 82 and 83 and the depression 85, 86, as in the preceding case, have ramps that are intended to facilitate the automatic engagement of element 11 on element 10, and if necessary, to take up the play between both elements.

Figure 9:
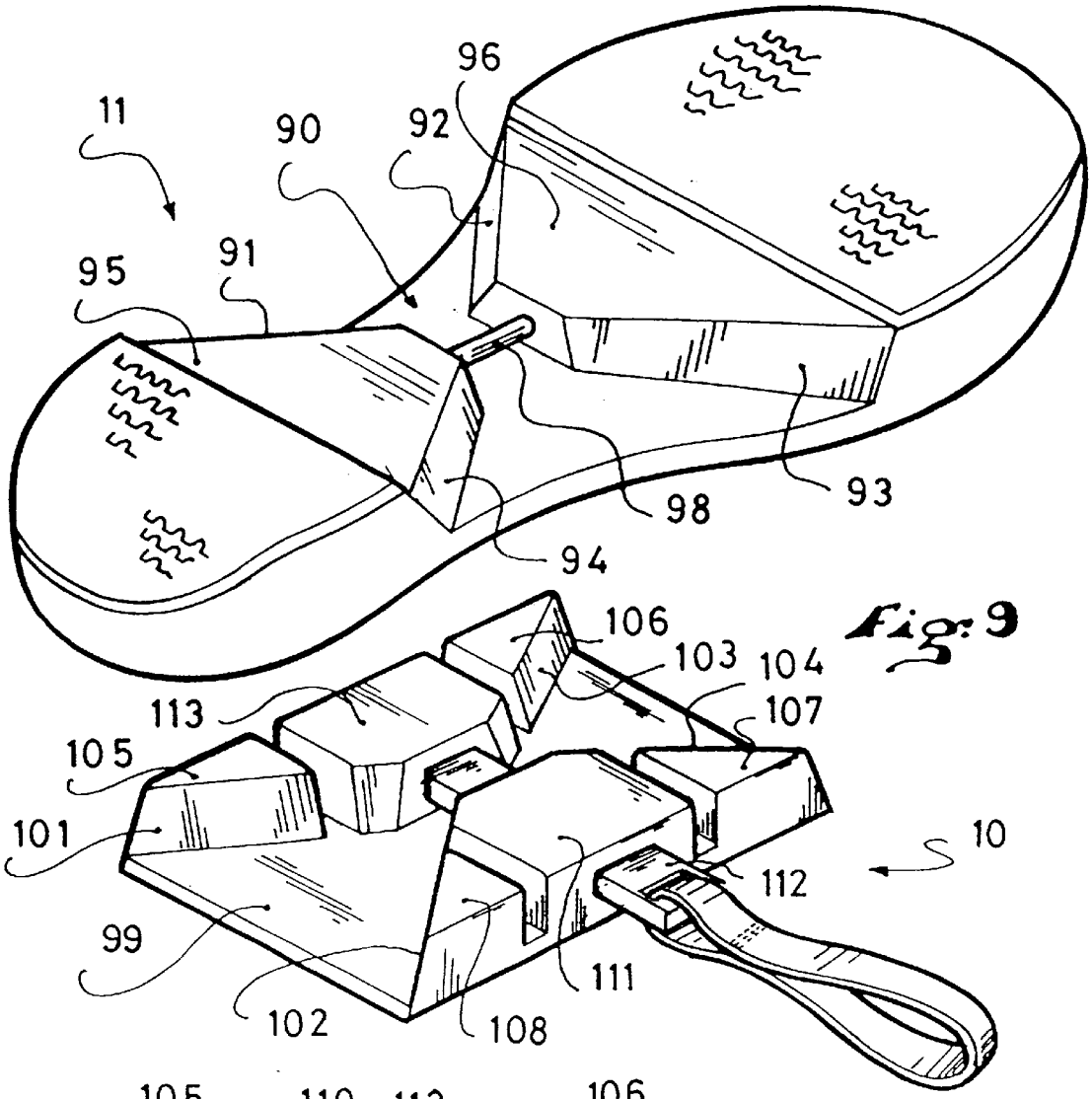
FIG. 9 also illustrates another variation of implementation of the invention.
Figure 10:
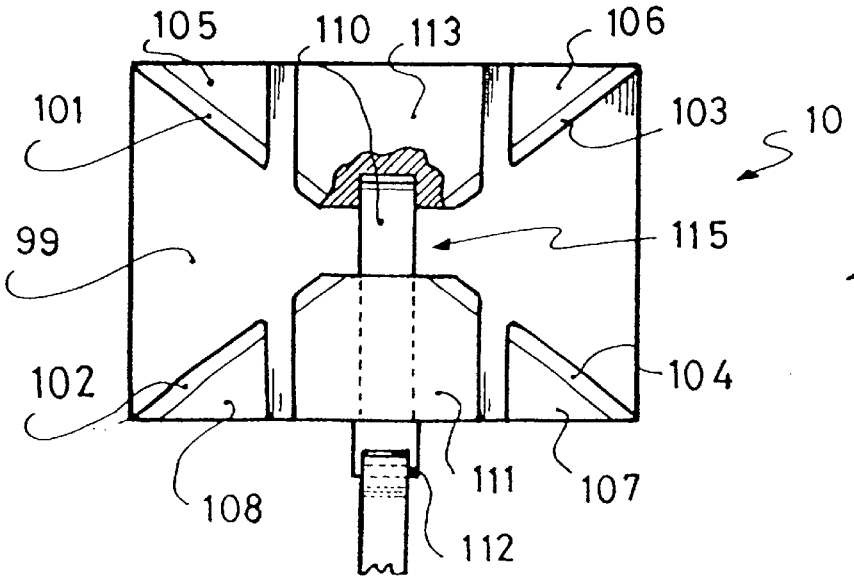
FIG. 10 is a top view of the retention element associated with the board represented in FIG. 9.

FIGS. 9 and 10 represent another variation of the implementation of the invention. According to this variation, element 11 associated with the boot has a kind of rib 90, oriented along the longitudinal direction of the sole. Here, the rib is formed by four faces 91, 92, 93, 94 converging two by two towards the median longitudinal direction of the sole and towards the central zone of the sole, in the manner of an X. In addition, according to the embodiment illustrated, rib 90 is in two parts 95 and 96, located towards the front and the rear of the boot. The two projection parts 95 and 96 are separated by a recess, and are connected to one another by a profile 98, forming a catch and being oriented along the longitudinal direction of the sole. In this variation, the profile 98 is positioned at a substantially central portion of the sole of the boot. As shown in FIG. 9, a discrete longitudinally extending space is formed between the rod 98 and the bottom of the retention element or sole 11, the space being limited longitudinally by end surfaces of the parts 95, 96.

Complementarily, element 10 associated with the board has a kind of groove 99 oriented along the longitudinal direction of the boot, of which the front and rear portions are flared. These front and rear portions are demarcated by four sides 101–104. Preferably, as is represented in FIGS. 9 and 10, the groove 99 is formed by four pins 105–108, separated from one another by recesses. Each of these pins bears a side 100–103 of the rib.

Preferably, the sides 93–96, 101–104 are inclined in the same way as in the preceding cases to form respective engagement surfaces when the rib is nested within the groove. In this embodiment, the surfaces generally face in a direction at an angle to the longitudinal direction. The orientation of the sides with respect to a longitudinal direction is non-limiting; it is, for example, on the order of 30–60°. This orientation can also be different towards the front and the rear of the boot. In addition, the figures show plane sides. This is non-limiting, and the sides could also be incurved or bulged.

The element 10 has a latching mechanism intended to cooperate with the profile 98 of the element 11 in the middle of the pins 105, 107 and 103, 104, along the longitudinal direction.

In the example illustrated, the latching mechanism comprises a sash bolt or jaw or latch 110, slidably guided along a transverse direction by a transverse support 111. The latch 110 can be maneuvered at the opening by a tie rod 112 which constitutes its extension beyond the support 11. Specifically, the latch 110 is inserted in the discrete space between the bottom of the rod 98 and the bottom of the retention element 11. As in the preceding case, an elastic means such as a spring can ensure the automatic closure of the latch.

Preferably, a second support 113 faces the first. The two supports form, therebetween, a recess 115 intended to receive the profile 98. Possibly, recess 115 is flared upwardly. In addition, the latch can have an upper ramp intended to facilitate automatic engagement of the profile, and a lower ramp intended to take up the play at this level.

According to the present variation, the latching mechanism only acts on the device associated with the boot along an upward vertical direction. The other degrees of freedom between the two elements 10 and 11 in rotation or translation are neutralized by the cooperation of the sides of the groove and the rib.

With respect to this variation, it must also be emphasized that the distinction between the rib and the groove becomes very blurred. Indeed, the element associated with the board could also be considered as having a transverse rib formed by the pins 105–108, and the element associated with the boot as having a rib oriented transversely. Therefore, the invention must be generally understood as the cooperation of two complementary forms, these forms neutralizing by their cooperation at least one portion of the relative movements between the two elements of the device, the other portion being neutralized by the latching mechanism.

Preferably, the complementary forms neutralize the rotation of the boot with respect to the board at least about a vertical axis, i.e., orthogonal to the board.

The dimensions of the forms which cooperate by nesting are non-limiting. Preferably, they fit into the contour of the sole of the boot and its projection on the board. There is no direct relationship between the length of a boot and the longitudinal dimensions of the forms, so that the element associated with the board can be used without modification or adjustment with boots of different length or volume. It is sufficient to provide the same complementary form and the same locations for the hooking and the latching mechanism on these different boots. Preferably, at the level of the boot, the rib or the groove extends from the metatarsal zone up to the heel zone. Thus, for a defined range of boot lengths, the complementary forms of the elements associated with the board and the boot extend from the metatarsal zone up to the heel of the longest foot. However , this is non-limiting with respect to the invention.

The elements 10 and 12 associated with the gliding board and the boot are obtained in any appropriate material. For example, they are obtained in a plastic material or a light alloy.

Of course, the present description is only given as an indicative example, and other implementations of the invention could be adopted without departing from the scope thereof.

In particular, the element associated with the board could be additionally equipped with any appropriate means for adjusting its orientation in the horizontal plane with respect to axis 2 of the board, and with any other appropriate means for adjusting, if necessary, its inclination with respect to a direction perpendicular to the surface of the board, as well as its longitudinal position on the board.

In addition, it is understood that the invention concerns any boot intended for any type of snowboarding, that would be equipped with a retention element of the type associated with the boot.

Likewise, it is understood that the invention also concerns any intermediary plate that would be used as an interface between a conventional boot and a gliding board equipped with a retention element of the type described hereinabove. In this case, the intermediary plate would be equipped with a complementary retention element of the type associated with the boot.

It is also understood that the invention also covers a gliding board that would be equipped with a retention element integrated to its structure, or attached, of the type associated with the gliding board.

Finally, although the invention has been described with reference of particular means, materials and embodiments, it is to be understood that the invention is not limited to the particulars disclosed and extends to all equivalents within the scope of the claims.

What is claimed:

1. A snowboard retention apparatus for a boot to be mounted on a snowboard, said apparatus comprising:

a first retention device adapted to be affixed to the snowboard and a second retention device adapted to be affixed to the boot, said first and second retention devices being complementary and forming a linkage assembly, during engagement between said first retention device and said second retention device, and located to ensure an opposition of relative movement between the boot and the snowboard in all directions;

one of said first retention device and said second retention device comprising a structure including a groove and the other of said first retention device and said second retention device comprising a rib, said rib generally complementary in shape with said groove, said rib and said groove having complementary fixed lateral surfaces for engagement to oppose relative lateral translational movement of said rib and said groove, and said rib being received in said groove in a nesting direction for said engagement against movement from said nesting direction, said rib and said groove being confined within a contour of the sole of the boot and a projection of the sole of the boot on the snowboard;

one of said first retention device and said second retention device further comprising a catch and the other of said first retention device and said second retention device further comprising a latch for retaining said catch and for retaining said first retention device and said second retention device to ensure said engagement;

a latch guide to guide said latch in a movement from an open position, to receive said catch, to a closed position, to retain said catch in said nesting direction against release; and a member that is adapted to be manually engaged at least to move said latch from said closed position to said open position to release said catch from said latch.

2. A snowboard retention apparatus according to claim 1, wherein:

said groove and said rib extend along a principal direction parallel to an upper surface of the snowboard; and said latch is located towards a middle area of said groove and said rib.

3. A snowboard retention apparatus according to claim 2, wherein:

said latch receives said catch for retaining said catch against movement in a direction of said rib.

4. A snowboard retention apparatus according to claim 1, wherein:

said latch comprises at least two sash bolts, said two sash bolts being longitudinally spaced apart along said rib and each being moveable from said open position to said closed position by member for moving said latch; and said catch comprises is adapted to be retained by said two sash bolts in said closed position of said sash bolts.

5. A snowboard retention apparatus according to claim 1, wherein:

said rib and said groove have respective engagement surfaces during said engagement between said first retention device and said second retention device.

6. A snowboard retention apparatus according to claim 5, wherein:

respective engagement surfaces of said rib and said groove generally face a longitudinal direction.

7. A snowboard retention apparatus according to claim 5, wherein:

respective engagement surfaces of said rib and said groove generally face a transverse direction.

8. A snowboard retention apparatus according to claim 5, wherein:

respective engagement surfaces of said rib and said groove generally face in a direction at an angle to a longitudinal direction.

9. A snowboard retention apparatus according to claim 1, wherein:

said rib and said groove have side surfaces that are inclined from vertical.

10. A snowboard retention apparatus according to claim 1, wherein:

at least one of said rib and said groove have side surfaces having at least one of an asymmetrical orientation and inclination.

11. A snowboard retention apparatus according to claim 1, wherein:

said rib has a top and said groove has a bottom; and said top of at least one of said rib and said bottom of said groove are inclined with respect to a horizontal plane parallel to an upper surface of the snowboard.

12. A snowboard retention apparatus according to claim 1, wherein:

said rib and said groove extend longitudinally with respect to the sole of the boot.

13. A snowboard retention apparatus according to claim 1, wherein:

said rib and said groove extend transversely with respect to the sole of the boot.

14. A snowboard retention apparatus according to claim 1, wherein:

each of said rib and said groove form an X-shape.

15. A snowboard retention apparatus according to claim 1, wherein:

said groove is formed in two longitudinally spaced-apart portions at a front and at a rear portion of the boot;

said rib comprises a longitudinally extending member; and said catch and said latch are positioned centrally along the length of said groove and said rib.

16. A snowboard retention apparatus according to claim 1, wherein:

said catch is a profile member oriented generally transversely to the length of said rib; and said latch comprises at least one notch for receiving said profile member and at least one sash bolt for closing said at least one notch and retaining said profile member within said notch, said at least one sash bolt being mounted for movement between opening and said closing of said notch.

17. A snowboard retention apparatus according to claim 16, wherein:

said rib comprises a pair of transversely spaced-apart longitudinally extending portions, said portions forming a longitudinally extending recess;

said retention apparatus furthermore comprising a central projecting form extending from a central portion of said groove, said central projecting form having at least a transverse dimension conforming to a complementary dimension of said longitudinally extending recess of said rib so that said central projecting form becomes nested within said longitudinally extending recess during nesting of said rib and said groove;

said catch comprising a pair of pins extending in opposite transverse directions from said central projecting form;

said latch comprises a pair of upwardly open notches in respective ones of said longitudinally extending portions of said rib for receiving said pins and a pair of sash bolts for blocking said pins at a bottom of said notches, each of said sash bolts being moveable from said open position to said closed position by said member for moving said latch for retaining said pins within said notches.

18. A snowboard retention apparatus according to claim 16, wherein:

said latch is housed and guided in said rib.

19. A snowboard retention apparatus according to claim 1, wherein:

said catch comprises a depression; and said latch is a slide mounted for movement into and out of said depression.

20. A snowboard retention apparatus according to claim 1, wherein:

said catch comprises a profile member extending generally longitudinally in a direction of said groove; and said latch comprises a sash bolt for retaining said profile member within said groove against vertical movement.

21. A snowboard retention apparatus according to claim 1 in combination with said boot, said second retention device being affixed to said boot.

22. A snowboard retention apparatus according to claim 1 in combination with an intermediate plate, said intermediate plate comprising an interface between the boot and the snowboard, said first retention device being affixed to said intermediate plate and said intermediate plate being adapted to be affixed to the snowboard.

23. A snowboard retention apparatus according to claim 1 in combination with said snowboard, said first retention device being affixed to said snowboard.

24. A retention device for engagement with a complementarily shaped retention device for retaining a snowboarding boot on a snowboard, said retention device comprising:

a groove for receiving, in nesting engagement, a rib of the complementarily shaped retention device, said groove being defined by fixed lateral surfaces for engagement with complementary fixed lateral surfaces of the rib for opposing relative lateral translational movement of said groove and the rib, said groove being confined within a contour of the sole of the boot and a projection of the sole of the boot on the snowboard;

said retention device further comprising one of a catch and a latch for retaining said catch and for securing together said retention device and said complementarily shaped retention device in said nesting engagement; and a guide, said latch being positioned for movement within said guide from an open position, for receiving said catch, to a closed position, for retaining said catch in said nesting direction against release, said latch having a manipulation portion for manual movement of said latch between said open position and said closed position, said latch further having a portion for manual engagement of said latch, voluntary manipulation of said latch being required to cause release of said catch from said latch.

25. A retention device for engagement with a complementarily shaped retention device for retaining a snowboarding boot on a snowboard, said retention device comprising:

a rib for receiving, in nesting engagement, a groove of the complementarily shaped retention device, said rib having fixed lateral surfaces for engagement with complementary fixed lateral surfaces of the groove for opposing relative lateral translational movement of said rib and the groove, said rib being confined within a contour of the sole of the boot and a projection of the sole of the boot on the snowboard;

said retention device further comprising one of a catch and a latch for retaining said catch and for securing together said retention device and said complementarily shaped retention device in said nesting engagement; and a guide, said latch being positioned for movement within said guide from an open position, for receiving said catch, to a closed position, for retaining said catch in said nesting direction against release, said latch having a manipulation portion for manual movement of said latch between said open position and said closed position, said latch further having a portion for manual engagement of said latch, voluntary manipulation of said latch being required to cause release of said catch from said latch.

26. A snowboarding boot comprising:

a sole extending longitudinally between front and rear, said sole comprising at least two projecting parts separated by a recess;

an attachment member affixed to said sole against movement with respect to said sole, said attachment member having at least an intermediate portion extending between said two projecting parts of said sole within said recess, said intermediate portion being spaced from a surface of said sole for engagement by a movable jaw of a binding apparatus; and a discrete longitudinally extending space being defined by said attachment member, said surface of said sole, and said projecting parts of said sole, said space being adapted to receive said movable jaw of a binding apparatus.

27. A snowboarding boot according to claim 26, wherein:

said attachment member comprises a longitudinally extending rod.

28. A snowboarding boot according to claim 26, wherein:

said attachment member is positioned at a substantially central portion of said sole.

29. A snowboarding boot according to claim 27, wherein:

said rod is positioned at a substantially central portion of said sole.

30. A snowboarding boot according to claim 26, wherein:

said attachment member is positioned within a periphery of said sole.

31. A snowboarding retention apparatus comprising:

a boot having a sole extending longitudinally between front and re said sole comprising at least two projecting parts separated by a recess;

an attachment member affixed to said sole against movement with respect to said sole;

a latching mechanism adapted to be secured to a snowboard, said latching mechanism comprising a movable jaw guided for movement between an open position and a closed retention position, said attachment member having at least an intermediate portion extending between said two projecting parts of said sole within said recess, said intermediate portion being spaced from a surface of said sole; and a discrete longitudinally extending space being defined by said attachment member, said surface of said sole, and said projecting parts of said sole, said discrete longitudinally extending space receiving said movable jaw of said latching mechanism in said closed retention position of said movable jaw.

32. A snowboarding retention apparatus according to claim 31, wherein:

said attachment member comprises a longitudinally extending rod.

33. A snowboarding retention apparatus according to claim 31, wherein:

said attachment member is positioned at a substantially central portion of said sole.

34. A snowboarding retention apparatus according to claim 32, wherein:

said rod is positioned at a substantially central portion of said sole.

35. A snowboarding retention apparatus according to claim 31, wherein:

said attachment member is positioned within a periphery of said sole.

36. A snowboard binding apparatus comprising:

(a) a boot including a sole having a recess therein, said boot including an attachment member affixed to said sole and having a portion positioned within said recess of said sole, a space existing between said attachment member and a lower surface portion of said sole, said attachment member extending in the same general direction as the longitudinal axis of said sole;

(b) a frame securable to a snowboard;

(c) a movable jaw attached to said frame, said movable jaw being movable from a blocking position and a non-blocking position, a portion of said movable jaw extending above said portion of said attachment member and below said lower surface portion of said sole in said blocking position of said movable jaw; and (d) a jaw movement mechanism attached to said frame and attached to said movable jaw for movement of said jaw from said non-blocking position to said blocking position and from said blocking position to said non-blocking position.

* * * * *